United States Patent [19]

Ueda

[11] Patent Number: 4,769,302

[45] Date of Patent: Sep. 6, 1988

[54] PHOTOSENSITIVE MEMBER INCORPORATING STYRYL COMPOUND

[75] Inventor: Hideaki Ueda, Kawanishi, Japan

[73] Assignee: Minolta Camera Kabushiki Kaisha, Osaka, Japan

[21] Appl. No.: 46,716

[22] Filed: May 7, 1987

[30] Foreign Application Priority Data

May 12, 1986 [JP] Japan ..... 61-108051

[51] Int. Cl.[4] ..... G03G 5/06

[52] U.S. Cl. ..... 430/59; 430/83; 430/95; 564/315; 564/433

[58] Field of Search ..... 430/59, 81, 83, 90, 430/95

[56] References Cited

U.S. PATENT DOCUMENTS

| | | | |
|---|---|---|---|
| 3,189,447 | 6/1965 | Neugebauer et al. . | |
| 3,820,989 | 6/1974 | Rule et al. . | |
| 3,873,312 | 3/1975 | Contois et al. | 430/83 X |
| 4,606,988 | 8/1986 | Sasaki | 430/59 |
| 4,642,280 | 2/1987 | Ueda | 430/83 X |

*Primary Examiner*—Roland E. Martin

*Attorney, Agent, or Firm*—Burns, Doane, Swecker & Mathis

[57] ABSTRACT

A photosensitive member according to the present invention comprises an electrically conductive substrate and a photosensitive layer comprising a binder resin and a styryl compound dispersed therein and represented by the general formula (I), (I)

wherein $R_1$, $R_3$ and $R_5$ each represent hydrogen or an alkyl, aryl, aralkyl or heterocyclic group, the aryl, aralkyl and heterocyclic groups having or not having a substituent, $R_2$, $R_4$ and $R_6$ each represent a substituted or unsubstituted aryl, aralkyl or heterocyclic group, $R_1$ and $R_2$, $R_3$ and $R_4$, and $R_5$ and $R_6$ taken together form a ring, and $R_7$, $R_8$ and $R_9$ each represent hydrogen or an alkyl, alkoxyl, aralkyl or aryl group.

A photosensitive member of this structure exhibits high sensitivity, is outstanding in the ability to retain charges and in charge transporting ability and less prone to deterioration when repeatedly used.

6 Claims, 1 Drawing Sheet

PHOTOSENSITIVE MEMBER INCORPORATING STYRYL COMPOUND

BACKGROUND OF THE INVENTION

1. Field of the Invention

The present invention relates to photosensitive members having incorporated therein an organic compound of low molecular weight, and more particularly to photosensitive members containing a styryl compound.

2. Description of the Prior Art

Electrophotographic processes generally known include the direct process, the powder image transfer process and the latent image transfer process. With the direct process, the surface of the photosensitive layer of a photosensitive member is charged and exposed to form an electrostatic latent image, which is then developed with developer to a toner image. The toner image is thereafter directly fixed to the photosensitive member to obtain a copy image. In the powder image transfer process, on the other hand, the toner image formed on the photosensitive member is transferred onto a transfer material such as paper and then fixed to obtain a copy image. With the latent image transfer process, the latent image formed on the photosensitive member is transferred onto transfer paper, and the latent image on the paper is then developed and fixed.

Conventional photoconductive materials for forming the photosensitive layer of photosensitive members for use in the electrophotographic processes of the above-mentioned type are inorganic photoconductive materials such as Se, CdS, ZnO and the like. These photoconductive materials have many advantages. For example, they are chargeable to a suitable potential in the dark, are less prone to the dissipation of charges in the dark and permit rapid dissipation of charges when irradiated with light. Nevertheless, these materials have various drawbacks. For example, photosensitive members of Se are costly to make and susceptible to thermal or mechanical shock and must therefore be handled with care. Photosensitive members of CdS or ZnO fail to exhibit stable sensitivity under high-humidity conditions and fail to retain stable characteristics for a prolonged period of time since the pigment incorporated therein as a sensitizer deteriorates owing to corona charging or undergoes discoloration due to exposure to light.

On the other hand, various organic photosensitive polymers inclusive of polyvinyl carbazole have been proposed. These polymers are superior to the above-mentioned inorganic photoconductive materials in film forming ability and lightweightness but are still inferior in sensitivity, durability and stability to changes in environmental conditions.

Organic photoconductive compounds of low molecular weight are preferable in that the properties or electrophotographic characteristics of the film to be formed are controllable by suitably selecting the kind and amount of binder to be used therewith, whereas these compounds must be highly compatible with the binder to be used in combination therewith.

Photosensitive members prepared from a dispersion of such an organic photoconductive compound of high or low molecular weight in a binder resin have the drawback of a high residual potential and low sensitivity due to the presence of many carrier traps. Accordingly, it has been proposed to overcome this drawback by using a charge carrier material in combination with the organic photoconductive material.

While many organic compounds have been proposed as charge carrier materials, the proposed compounds have various actual problems. For example, 2,5-bis(p-diethylaminophenyl)-1,3,4-oxadiazole disclosed in U.S. Pat. No. 3,189,447 has low compatibility with binders and is liable to separate out in the form of crystals. The diarylalkane derivative mentioned in U.S. Pat. No. 3,820,989 has good compatibility with binders, whereas the photosensitive member incorporating the derivative undergoes variations in sensitivity when repeatedly used. Unexamined Japanese Patent Publication No. SHO 54-59143 discloses hydrazone compounds which, although assuring relatively satisfactory initial sensitivity and residual potential characteristics, have the drawback that the sensitivity reduces when the photosensitive member is used repeatedly, hence low durability.

SUMMARY OF THE INVENTION

The main object of the present invention is to provide a photosensitive member which is free of the foregoing drawbacks and satisfactory in sensitivity and chargeability.

Another object of the invention is to provide a photosensitive member having stabilized repetition characteristics and high durability.

Another object of the invention is to provide a photosensitive member having incorporated therein a styryl compound which is excellent in compatibility with binders and charge transport ability.

These and other objects of the present invention is fulfilled by providing a photosensitive member which comprises a substrate and a photosensitive layer comprising a styryl compound, the styryl compound being represented by the general formula (I):

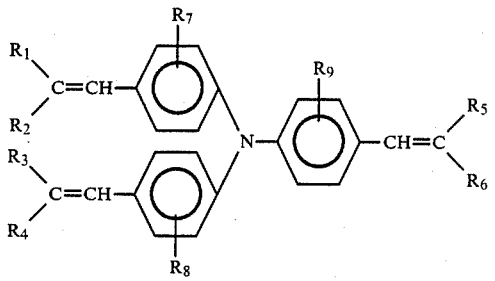

(I)

wherein $R_1$, $R_3$ and $R_5$ each represent hydrogen or an alkyl, aryl, aralkyl or heterocyclic group, the aryl, aralkyl and heterocyclic groups having or not having a substituent, $R_2$, $R_4$ and $R_6$ each represent a substituted or unsubstituted aryl, aralkyl or heterocyclic group, $R_1$ and $R_2$, $R_3$ and $R_4$, and $R_5$ and $R_6$ taken together form a ring, and $R_7$, $R_8$ and $R_9$ each represent hydrogen or an alkyl, alkoxyl, aralkyl or aryl group.

DETAILED DESCRIPTION OF THE INVENTION

Figure 1:
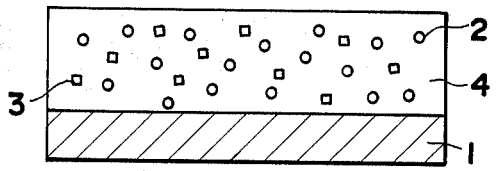
FIGS. 1, 4 and 5 are diagrams showing photosensitive members of the dispersion type embodying the invention and each comprising a photosensitive layer formed over an electrically conductive substrate.

In the formula (I) representing the styryl compound of the present invention, one of the groups in each of the pairs $R_1$ and $R_2$, $R_3$ and $R_4$, and $R_5$ and $R_6$ is preferably aryl having a substituent, and $R_7$, $R_8$ and $R_9$ are each preferably hydrogen, alkyl or alkoxyl. The compounds having such groups are desirable in respect to solubility and sensitivity.

Examples of preferred styryl compounds of the invention represented by the formula (I) are those having the following structural formula. However, these examples are in no way limitative.

(1)

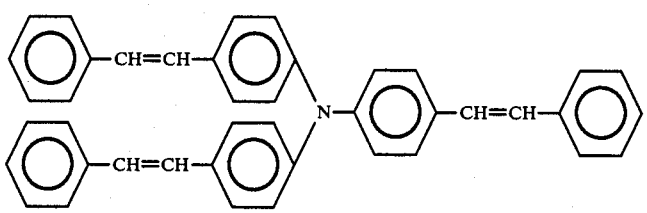

(2)

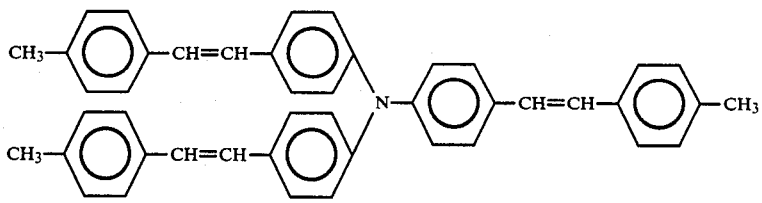

(3)

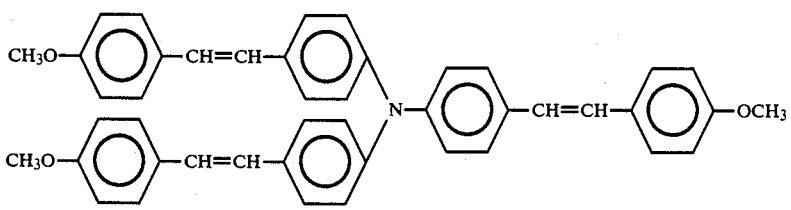

(4)

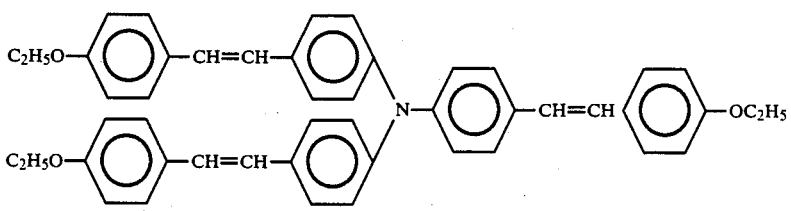

(5)

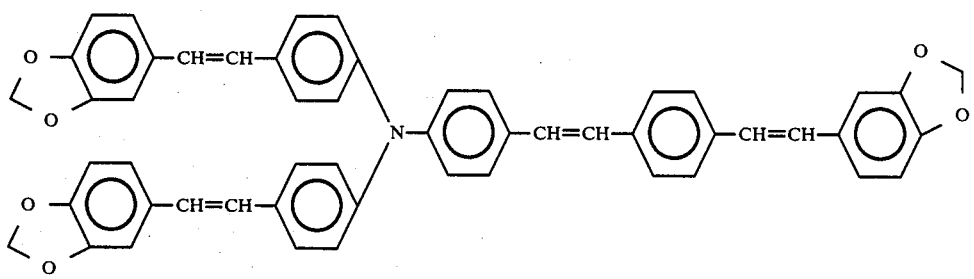

-continued
(6)
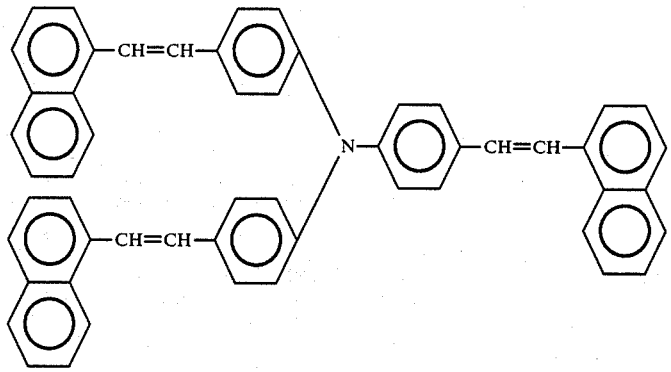
(7)
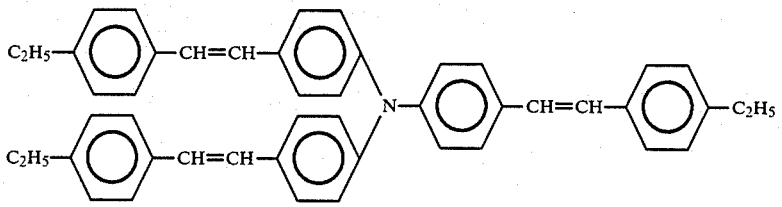
(8)
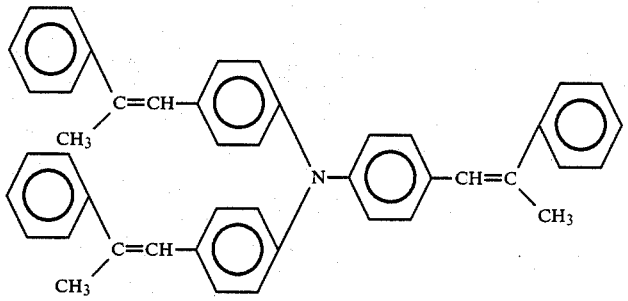
(9)
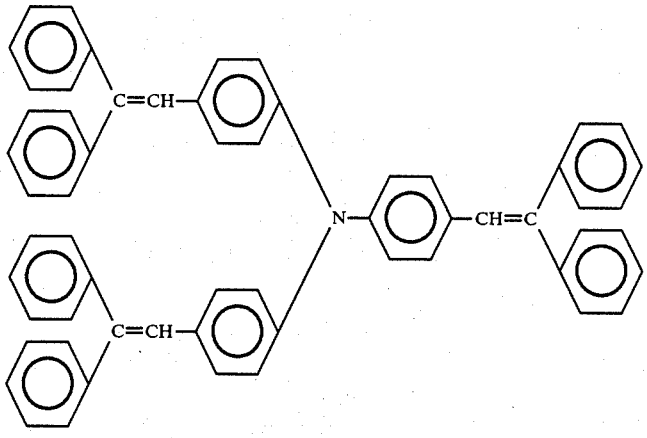

-continued
(10)
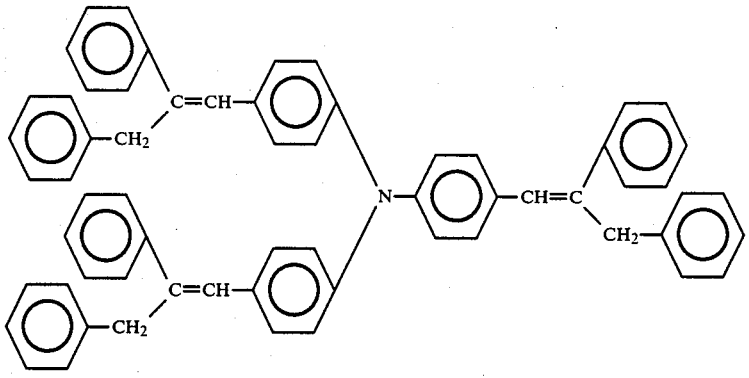
(11)
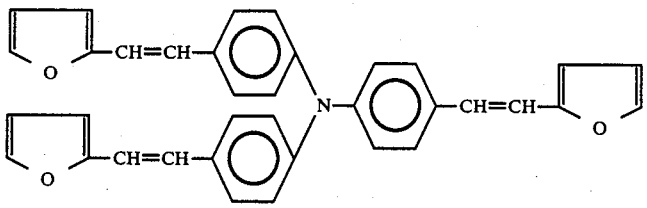
(12)
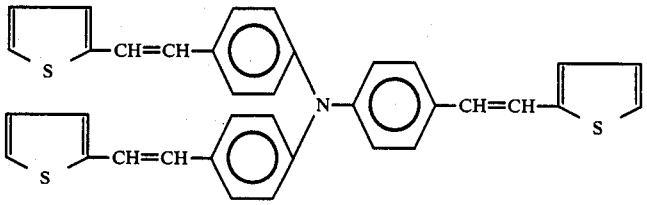
(13)
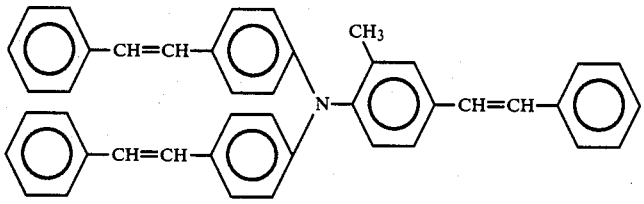
(14)
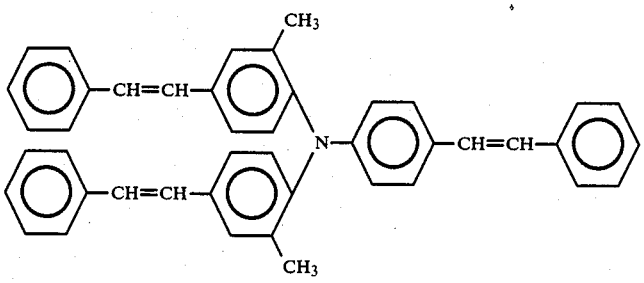
(15)
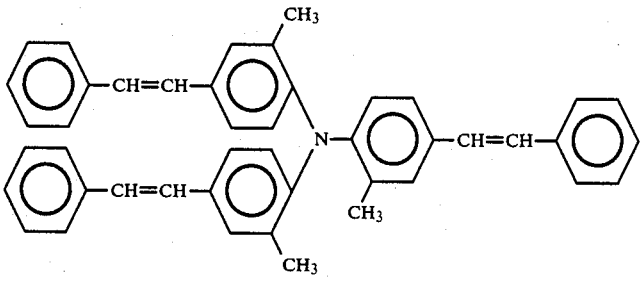

-continued
(16)
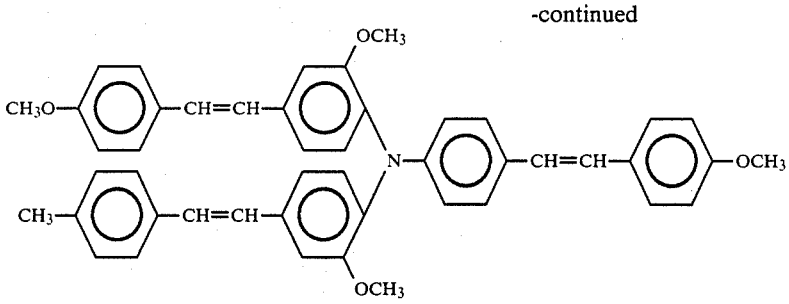
(17)
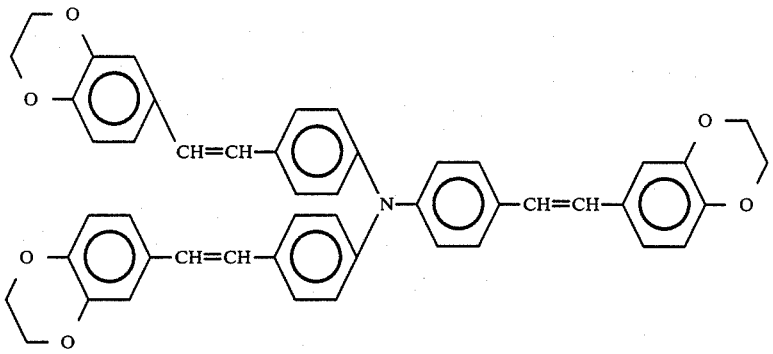
(18)
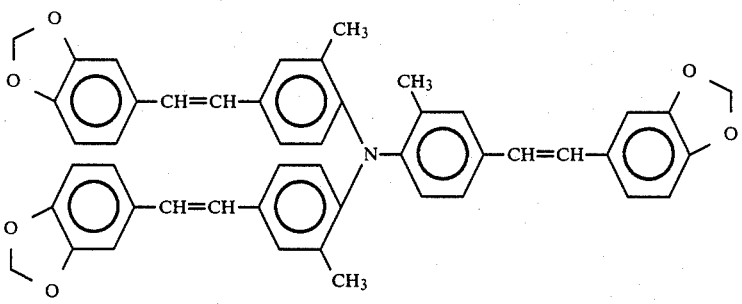
(19)
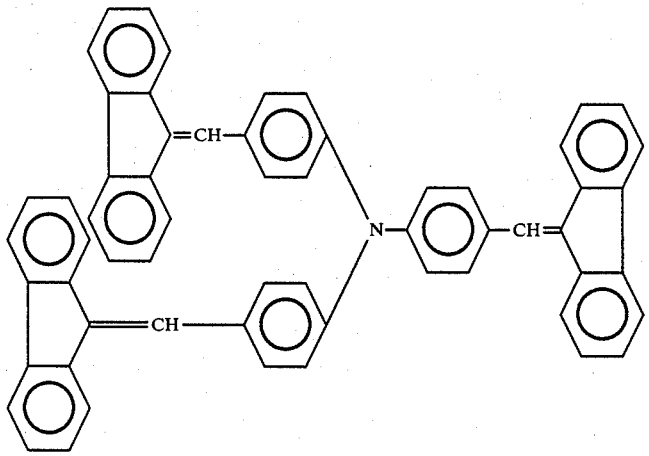
(20)
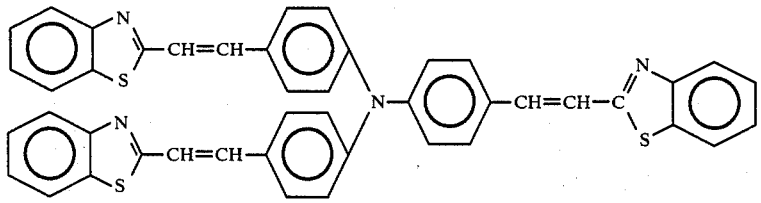
The styryl compounds of the present invention can be prepared by known processes, for example, by reacting

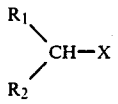

(II)

wherein $R_1$ and $R_2$ have the same meaning as in the formula (I), and X is a triphenylphosphonium group or trialkylphosphonium salt represented by $—P^+(R_{10})_3M^-$ (wherein $R_{10}$ is alkyl or aryl, and M is a halogen ion) or a dialkylphosphite group represented by $—PO(OR_{11})_2$ (wherein $R_{11}$ is alkyl), the formula (III):

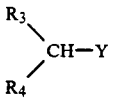

(III)

wherein $R_3$ and $R_4$ have the same meaning as in the formula (I), and Y has the same meaning as X in the formula (II), or the formula (IV):

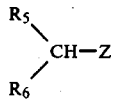

(IV)

wherein $R_5$ and $R_6$ have the same meaning as in the formula (I), and X has the same meaning as Y in the formula (III), with a triformyl compound represented by the formula (V):

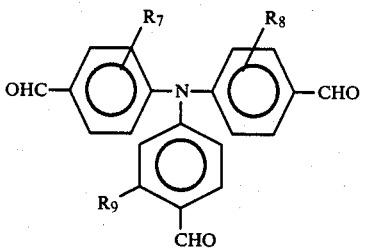

(V)

wherein $R_7$, $R_8$ and $R_9$ have the same meaning as in the formula (I).

The phosphorus compounds represented by the formulae (II), (III) and (IV) can be easily prepared by heating a corresponding halomethyl compound, and a triarylphosphine, trialkylphosphine or trialkyl phosphite together, directly or in a solvent such as toluene or xylene.

Examples of reaction solvents useful for the foregoing process for preparing the styryl compound are inert solvents including hydrocarbons, alcohols and ethers, such as methanol, ethanol, isopropanol, butanol, 2-methoxyethanol, 1,2-dimethoxyethane, bis(2-methoxyethyl)ether, dioxane, tetrahydrofuran, toluene, xylene, dimethyl sulfoxide, N,N-dimethylformamide, N-methylpyrrolidone, 1,3-dimethyl-2-imidazolidone, etc. Among these solvents, polar solvents, such as N,N-dimethylformamide and dimethyl sulfoxide, are especially desirable.

Examples of useful condensing agents for the reaction are sodium hydroxide, potassium hydroxide, sodium amide, sodium hydride, and alcoholates such as sodium methylate and potassium tert-butoxide. The reaction temperature can be selected from a wide range of from about 0° C. to about 100° C., preferably from 10° C. to 80° C., depending on the stability of the solvent to the condensing agent, the reactivity of the components to be condensed and the reactivity of the condensing agent.

FIGS. 1 to 5 schematically show the structure of photosensitive members of the invention incorporating a styryl compound for illustrative purposes.

FIG. 1 shows a photosensitive member which comprises a photosensitive layer 4 formed on a substrate 1 and prepared from a photoconductive material 3 and a charge transport material 2 as admixed with a binder. The styryl compound of the invention is used as the charge transport material.

Figure 2:
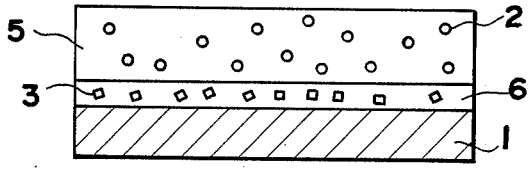
FIGS. 2 and 3 are diagrams showing photosensitive members of the function-divided type embodying the invention and each comprising a charge generating layer and a charge transport layer which are formed over an electrically conductive substrate.

FIG. 2 shows a photosensitive member of the function-divided type comprising a charge generating layer 6 and a charge transport layer 5 which are combined to serve as a photosensitive layer. The charge transport layer 5 is formed over the surface of the charge generating layer 6. The styryl compound of the invention is incorporated in the charge transport layer 5.

Figure 3:
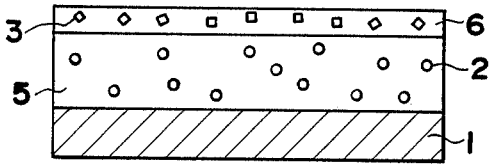

FIG. 3 shows another photosensitive member of the function-divided type which, like the one shown in FIG. 2, comprises a charge generating layer 6 and a charge transport layer 5. In converse relation to the member shown in FIG. 2, the charge generating layer 6 is formed over the surface of the charge transport layer 5.

Figure 4:
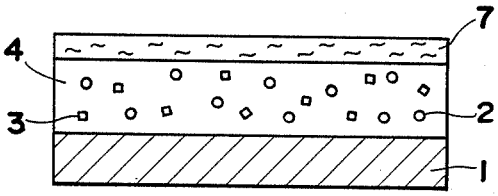

The photosensitive member shown in FIG. 4 comprises the one shown in FIG. 1 and a surface protective layer 7 formed over the surface of the photosensitive layer 4. The photosensitive layer 4 may be separated into a charge generating layer 6 and a charge transport layer 5 to provide a photosensitive member of the function-divided type. The surface protective layer 7 is provided for preventing the surface of the photosensitive layer 4 from abrasion during use. A desired resin is usable for the protective layer.

Figure 5:
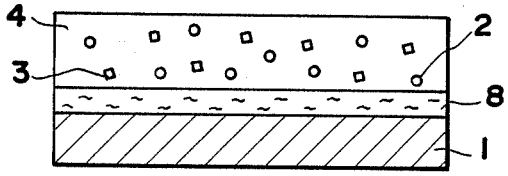

FIG. 5 shows a photosensitive member comprising a substrate 1, a photosensitive layer 4 and an intermediate layer 8 formed between these two layers. The intermediate layer 8 can be provided to give enhanced adhesion, afford improved coatability, protect the substrate and assure improved injection of charges from the substrate into the photoconductive layer. Polyimide resin, polyester resin, polyvinyl butyral resin, casein, etc. are useful for forming the intermediate layer. The photosensitive member of this type may also be modified to the function-divided type.

The photosensitive member of the present invention can be prepared by dissolving or dispersing the styryl compound of the formula (I) and a binder in a suitable solvent to obtain a coating composition, applying the composition to an electrically conductive substrate and drying the coating. When required, a photoconductive material, electron-attracting compound, sensitizing dye and other pigments can be admixed with the coating composition. The dried coating, i.e., the photosensitive layer, is usually 5 to 30 μm, preferably 6 to 20 μm, in thickness.

The photosensitive member of the dispersion type having the same construction as the member of FIG. 1 described, i.e., a photosensitive layer formed on an electrically conductive substrate, is prepared by dispersing a finely divided photoconductive material in a solution of the styryl compound and a binder resin, coating the conductive substrate with the dispersion and drying the coating to form the photosensitive layer.

The photosensitive layer thus formed is 3 to 30 μm, preferably 5 to 20 μm, in thickness. Use of too small an amount of the photoconductive material results in lower sensitivity, whereas presence of an excess of the material leads to impaired chargeability or gives reduced strength to the photosensitive layer. It is desirable that the photosensitive layer contain the photoconductive material in an amount of 0.01 to 2 parts by weight, more desirably 0.05 to 1 part by weight, per part by weight of the binder resin. The amount of styryl compound is preferably 0.01 to 2 parts by weight, more preferably 0.02 to 1.2 parts by weight, per part by weight of the binder resin. The styryl compound may be used conjointly with a high-molecular-weight photoconductive material, such as polyvinylcarbazole, which itself is serviceable as a binder resin, or with some other charge transport material such as hydrazone.

More specifically, the photosensitive member of the function-divided type having the same structure as the member of FIG. 2 described, i.e., having a charge generating layer provided on an electrically conductive substrate and a charge transport layer on the layer, can be prepared by coating the substrate with a charge generating material by vacuum evaporation or by coating the substrate with a composition obtained by dispersing the material in a suitable solvent which may contain a binder resin dissolved therein when so required and drying the coating, to form the charge generating layer, and further coating this layer with a solution of the styryl compound serving as a charge transport material and a binder resin in a suitable solvent. The charge generating layer thus formed is up to 4 μm, preferably up to 2 μm, in thickness, while the charge transport layer is 3 to 30 μm, preferably 5 to 20 μm, in thickness. It is suitable that the charge transport layer contain the styryl compound in an amount of 0.02 to 2 parts by weight, more suitably 0.03 to 1.3 parts by weight, per part by weight of the binder resin. The styryl compound may be used in combination with some other charge transport material. When this material is a high-molecular-weight charge transport material which itself is serviceable as a binder, there is no need to use other binder. As in the photosensitive member described with reference to FIG. 3, the charge transport layer may be formed on the conductive substrate, with the charge generating layer formed over the transport layer.

Examples of photoconductive materials useful for the present photosensitive member are organic substances such as bisazo dyes, triarylmethane dyes, thiazine dyes, oxazine dyes, xanthene dyes, cyanine coloring agents, styryl coloring agents, pyrylium dyes, azo pigments, quinacridone pigments, indigo pigments, perylene pigments, polycyclic quinone pigments, bisbenzimidazole pigments, indanthrone pigments, squalylium pigments and phthalocyanine pigments; and inorganic substances such as selenium, selenium-tellurium, selenium-arsenic, cadmium sulfide and amorphous silicon. Any other material is also usable insofar as it generates charge carriers very efficiently upon absorption of light.

The binder to be used in the invention is any of known thermoplastic resins or thermosetting resins having electrically insulating properties, light-curable resins and photoconductive resins.

Although in no way limitative, examples of suitable binders are thermoplastic binders such as saturated polyester resin, polyamide resin, acrylic resin, ethylene-vinyl acetate copolymer, ion-crosslinked olefin copolymer (ionomer), styrene-butadiene block copolymer, polyalylate, polycarbonate, vinyl chloride-vinyl acetate copolymer, cellulose ester, polyimide and styrol resin; thermosetting binders such as epoxy resin, urethane resin, silicone resin, phenolic resin, melamine resin, xylene resin, alkyd resin and thermosetting acrylic resin; light-curable resins; photoconductive resins such as poly-N-vinylcarbazole, polyvinylpyrene and polyvinylanthracene; etc. These binders are usable singly or in admixture.

The electrically insulating resin is preferably at least $1\times10^{12}$ ohm-cm in volume resistivity as measured singly. More desirable examples are polyester resin, polycarbonate and acrylic resins.

According to the invention, the binder may be used conjointly with plasticizes such as paraffin halide, polybiphenyl chloride, dimethylnaphthalene, dibutyl phthalate and o-terphenyl; electron-attracting sensitizers such as chloranil, tetracyanoethylene, 2,4,7-trinitro-9-fluorenone, 5,6-dicyanobenzoquinone, tetracyanoquinodimet tetrachloroacetic anhydride and 3,5-dinitrobenzoic acid; and sensitizers such as Methyl Violet, Rhodamine B, cyanine dye, pyrylium salt and thiapyrylium salt.

The photosensitive member thus prepared may have an adhesion or intermediate layer 8 or a surface protective layer 7 when so required as already described with reference to FIG. 4 or 5.

Photosensitive members of various structures can be fabricated according to the invention for use. They are satisfactorily chargeable positively or negatively to exhibit high sensitivity, less prone to deterioration when repeatedly used, and outstanding in the ability to retain charges, in sensitivity stability to changes in environmental conditions and in durability.

EXAMPLE 1

One part by weight of ϵ-type copper phthalocyanine (produced by Toyo Ink Mfg. Co., Ltd.), 1 part by weight of polyester resin (Villon 200; produced by Toyobo Co., Ltd.) and 50 parts by weight of tetrahydrofuran were placed into a ball mill pot and treated for 24 hours for dispersion to obtain a photosensitive coating composition. The composition was applied to an aluminum substrate and dried to form a charge generating layer, 1 μm in thickness.

The charge generating layer was further coated with a solution of 10 parts by weight of the styryl compound (1) mentioned above and 10 parts by weight of polycarbonate resin (Panlite K 1300; produced by Teijin Kasei Co.) in 100 parts by weight of tetrahydrofuran and dried, forming a charge transport layer, 15 μm in thickness, whereby a photosensitive member was prepared.

The photosensitive member thus prepared was incorporated into a commercial electrophotographic copying machine (EP 450Z; produced by Minolta Camera Co., Ltd.) and corona-charged with a voltage of −6.0 kV to measure the initial potential V0 (V), the amount of exposure, $E_{\frac{1}{2}}$ (lux-sec), required for V0 to reduce to $\frac{1}{2}$, and the initial potential decay rate DDR5 (%) when the member was allowed to stand in the dark for 5 seconds.

EXAMPLES 2–4

Photosensitive members having the same structure as the member of Example 1 were prepared in the same manner as in Example 1 with the exception of using the styryl compounds(2), (3) and (4) for Examples 2, 3 and 4, respectively, in place of the styryl compound (1).

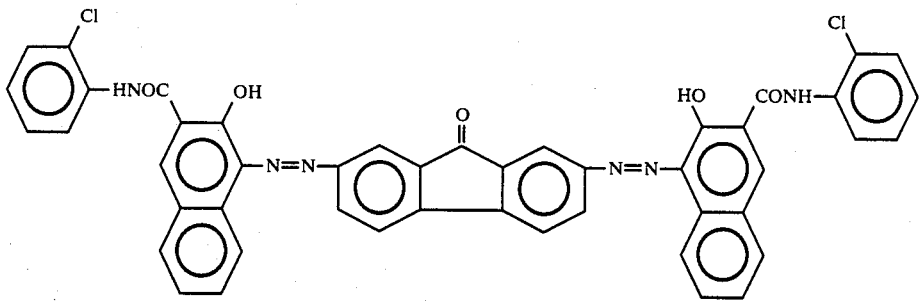

Formula (A)

The photosensitive members obtained were checked for V0, $E\frac{1}{2}$ and DDR5 in the same manner as in Example 1.

EXAMPLE 5

Copper phthalocyanine (50 parts by weight) and 0.2 part by weight of tetrahydrocopper phthalocyanine were dissolved in 500 parts by weight of 98% concentrated sulfuric acid with full stirring. The solution was placed into 5000 parts by weight of water to cause a photoconductive composition of copper phthalocyanine and tetrahydrocopper phthalocyanine to separate out, followed by filtration, washing with water and drying in a vacuum at 120° C.

The resulting photoconductive composition (10 parts by weight), 22.5 parts by weight of thermosetting acrylic resin (Acrydic A 405; produced by Dainippon Ink & Chemicals Inc.), 7.5 parts by weight of melamine resin (Super Beckamine J820; produced by Dainippon Ink & Chemicals Inc.) and 15 parts by weight of the aforementioned styryl compound (5) were placed into a ball mill pot along with 100 parts by weight of a solvent mixture of methyl isobutyl ketone and xylene in equal amounts. These ingredients were treated for 48 hours for dispersion to obtain a photoconductive coating composition, which was then applied to an aluminum substrate and dried to obtain a photosensitive layer, about 15 μm in thickness, whereby a photosensitive member was prepared.

The V0, $E\frac{1}{2}$ and DDR5 values of the photosensitive member thus obtained were measured in the same manner as in Example 1 except that the voltage applied by corona charging was +6 kV.

EXAMPLES 6-8

Photosensitive members having the same structure as the member of Example 5 were prepared in the same manner as in Example 5 with the exception of using the styryl compounds (11), (15) and (19) for Examples 6, 7 and 8, respectively, in place of the styryl compound (5).

The V0, $E\frac{1}{2}$ and DDR5 values of the members thus obtained were measured in the same manner as in Example 5.

EXAMPLE 9

Two parts by weight of the disazo pigment represented by the following formula (A), 1 part by weight of polyester resin (Villon 200; produced by Toyobo Co., Ltd.) and 100 parts by weight of methyl ethyl ketone were placed into a ball mill pot and treated for 24 hours for dispersion to obtain a photosensitive coating composition. The composition was applied to an aluminum substrate and dried, giving a charge generating layer, 0.1 μm in thickness.

The charge generating layer was further coated with a solution of 10 parts by weight of the styryl compound (6) and 10 parts by weight of polyalylate resin (U-100; produced by Unitika, Ltd.) in 100 parts by weight of chlorobenzene. The coating was dried, giving a charge transport layer, 15 μm in thickness, whereby a photosensitive member was prepared.

The V0, $E\frac{1}{2}$ and DDR5 values of the member thus obtained were measured in the same manner as in Example 1.

EXAMPLE 10

A photosensitive member having the same sturcture as the member of Example 9 was prepared in the same manner as in Example 9 except that the styryl compound (9) was used in place of the styryl compound (6).

The V0, $E\frac{1}{2}$ and DDR5 values of the member thus obtained were measured in the same manner as in Example 1.

COMPARATIVE EXAMPLE 1

A photosensitive member having the same structure as the member of Example 10 was prepared in the same manner as in Example 10 except that the styryl compound of the following formula was used in place of the styryl compound (9).

Formula:

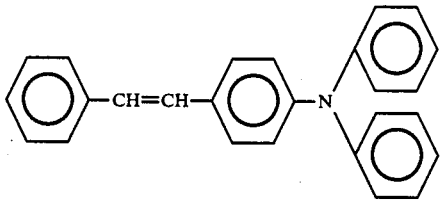

The V0, $E\frac{1}{2}$ and DDR5 values of the member thus obtained were measured in the same manner as in Example 1.

Table 1 shows the measurements of V0, $E\frac{1}{2}$ and DDR5 of the photosensitive members obtained in Examples 1 to 10 and Comparative Example 1.

TABLE 1

| | V0 (V) | $E\frac{1}{2}$ (lux-sec) | DDR5 (%) |
|---|---|---|---|
| Example 1 | −630 | 3.8 | 4.0 |
| Example 2 | −640 | 4.0 | 5.0 |
| Example 3 | −650 | 4.2 | 4.0 |
| Example 4 | −640 | 3.9 | 4.5 |
| Example 5 | +630 | 1.7 | 11.0 |
| Example 6 | +620 | 2.0 | 12.0 |

TABLE 1-continued

| | V0 (V) | $E_{\frac{1}{2}}$ (lux-sec) | DDR5 (%) |
|---|---|---|---|
| Example 7 | +630 | 1.8 | 10.5 |
| Example 8 | +630 | 2.1 | 11.0 |
| Example 9 | −640 | 1.9 | 5.0 |
| Example 10 | −650 | 1.8 | 4.5 |
| Comp. Ex. 1 | −640 | 6.5 | 6.0 |

Table 1 reveals that all the photosensitive members of Examples 1 to 10 according to the invention are at least 600 V in initial surface potential, sufficiently low in dark decay rate for use as photosensitive members, satisfactory in chargeability and excellent in sensitivity. When the photosensitive members of Examples 5 and 6 were repeatedly tested for making 10,000 copies, the copy images initially obtained and those finally obtained were all sharp and excellent in tone reproduction, indicating no variations in sensitivity. This shows that the photosensitive members of the invention are stable in repetition characteristics and have high durability.

On the other hand, the photosensitive member of Comparative Example 1, which was free from the styryl compound of the invention, was low in photosensitivity and substantially unusable.

What is claimed is:

1. A photosensitive member which comprises:

an electrically conductive substrate; and a photosensitive layer comprising a binder resin and a styryl compound dispersed therein and represented by the general formula (I),

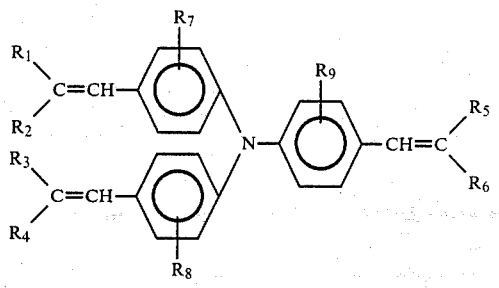

(I)

wherein $R_1$, $R_3$ and $R_5$ each are hydrogen or an alkyl, aryl, aralkyl or heterocyclic group, the aryl, aralkyl and heterocyclic groups having or not having a substituent, $R_2$, $R_4$ and $R_6$ each are a substituted or unsubstituted aryl, aralkyl or heterocyclic group, $R_1$ and $R_2$, $R_3$ and $R_4$, and $R_5$ and $R_6$ taken together form a ring, and $R_7$, $R_8$ and $R_9$ each are hydrogen or an alkyl, alkoxyl, aralkyl or aryl group.

2. A photosensitive member as claimed in Claim 1 wherein said styryl compound is dispersed in the binder resin in an amount of 0.01 to 2 parts by weight per part by weight of the resin.

3. A photosensitive member as claimed in claim 1 wherein said photosensitive layer comprises a charge generating layer and a charge transporting layer, said styryl compound being contained in said charge transporting layer.

4. A photosensitive member as claimed in claim 1 wherein said styryl compound is dispersed in the binder resin in an amount of 0.03 to 1.3 parts by weight per part by weight of the resin.

5. A photosensitive member as claimed in claim 3 wherein said charge generating layer comprises phthalocyanine.

6. A photosensitive member as claimed in claim 3 wherein said charge generating layer comprises a disazo pigment.

* * * * *